US007483340B2

(12) United States Patent
Dias

(10) Patent No.: US 7,483,340 B2
(45) Date of Patent: Jan. 27, 2009

(54) TIMEPIECE

(75) Inventor: Carlos Dias, Carouge (CH)

(73) Assignee: Manufacture Roger Dubuis S.A., Meyrin (CH)

( * ) Notice: Subject to any disclaimer, the term of this patent is extended or adjusted under 35 U.S.C. 154(b) by 0 days.

(21) Appl. No.: 11/917,546

(22) PCT Filed: Jun. 12, 2006

(86) PCT No.: PCT/CH2006/000313

§ 371 (c)(1),
(2), (4) Date: Dec. 14, 2007

(87) PCT Pub. No.: WO2006/133587

PCT Pub. Date: Dec. 21, 2006

(65) Prior Publication Data

US 2008/0198696 A1 Aug. 21, 2008

(30) Foreign Application Priority Data

Jun. 15, 2005 (EP) ..... 05405381

(51) Int. Cl.
*G04B 19/22* (2006.01)

(52) U.S. Cl. ..... 368/27

(58) Field of Classification Search ..... 368/21, 368/22, 27, 185

See application file for complete search history.

(56) References Cited

U.S. PATENT DOCUMENTS 3,633,354 A * 1/1972 Stemmler ..... 368/27
3,675,411 A * 7/1972 Sakuma ..... 368/27
4,634,287 A * 1/1987 Vuilleumier et al. ..... 368/27
4,945,521 A * 7/1990 Klaus ..... 368/21
4,998,230 A * 3/1991 Fini ..... 368/27
5,323,363 A 6/1994 Hysek et al.
6,134,186 A * 10/2000 Jang ..... 368/27

FOREIGN PATENT DOCUMENTS

EP 1321831 A 6/2003
EP 1413934 A 4/2004
EP 1462876 A 9/2004

OTHER PUBLICATIONS

International Search Report of PCT/CH2006/000313, date of mailing Sep. 29, 2006.

* cited by examiner

*Primary Examiner*—Vit W Miska
(74) *Attorney, Agent, or Firm*—Westerman, Hattori, Daniels & Adrian, LLP.

(57) ABSTRACT

The invention concerns a timepiece comprising a dial provided with means (7*a*, 7*b*) for selective and simultaneous analog display of respective hours of several time zones, distributed on two non-coaxial superimposed annular discs (9, 10) of similar diameters, arranged beneath said dial and each of which is divided into twelve sectors each corresponding to a time zone. The dial has two diametrically opposite windows (5, 6), arranged on a diameter passing through the swivel axes of the two annular discs (9, 10), each being located opposite a segment of the trajectory of the respective discs. Each of the discs (9, 10) is linked to a manual selection member (23, 24) and, by a one-way kinematic link (17, 18), to an hour display member (7*a*, 7*b*) of the corresponding time zone.

16 Claims, 6 Drawing Sheets

TIMEPIECE

The present invention relates to a timepiece comprising a dial provided with means for selective and simultaneous analog display of the respective hours of a plurality of time zones, in which each of the twenty-four time zones is designated by at least one representative geographical location.

Such timepieces, by which the hour corresponding to different time zones can be ascertained, are known. Given that the number of these zones is twenty-four with a one hour stagger between the adjacent zones, the angle available for the indication of a geographical location characteristic of each time zone is only 15°, which is little for inscribing there the characteristic geographical indications, especially when the timepiece in question is a wristwatch whose diameter is relatively small.

In general, furthermore, these disks containing twenty-four time zones are generally associated, say, with an indication from 1 to 24 hours, which is unusual, especially in the Anglo-Saxon countries where the hour display is based on 2×12 hours with the notations AM and PM. When the hour display is based on 2×12 hours, the problem is that of knowing if the hour indicated in another time zone is an AM hour or a PM hour.

In EP 1 462 876 there has already been proposed a timepiece provided with a display of two time zones, one to indicate the local time and the other the GMT time, in which the hours advance step by step and the minutes comprise a hand common to the two time zones. Such a system does not require the time zone to be indicated.

In EP 1 321 831 there has also been proposed a display comprising a disk for indicating the hours, another for indicating the time zone and a hand for indicating the minutes. A pusher allows the hour and the time zone to be changed simultaneously by one hour steps. Such a timepiece therefore allows the time zone to be easily changed while preserving the indication of the name of the characteristic geographical locations, but it allows only one time zone to be displayed. Moreover, since the disk containing the names of the time zones is actuated by one-twelfth of a step, like that of the hours, each time zone truly corresponds to two zones which are staggered relative to each other by twelve hours.

The object of the present invention is to allow two time zones to be displayed simultaneously, by substantially increasing the angle of the sector for the display of each of the twenty-four time zones.

To this end, the subject of the present invention is a timepiece as claimed in claim 1.

The presence of two disks for displaying the geographical names representative of the different time zones allows the angular dimension of each sector bearing these geographical names to be doubled. It also allows two displays of the respective hours of the different displayed time zones to be combined, these hours changing at the same time as the time zones by virtue of the unidirectional kinematic links between the respective disks and these hour displays.

Other advantages will emerge from the following description of an embodiment of the timepiece forming the subject of the invention, which is illustrated schematically and by way of example with the aid of the appended drawings, in which.

Figure 1:
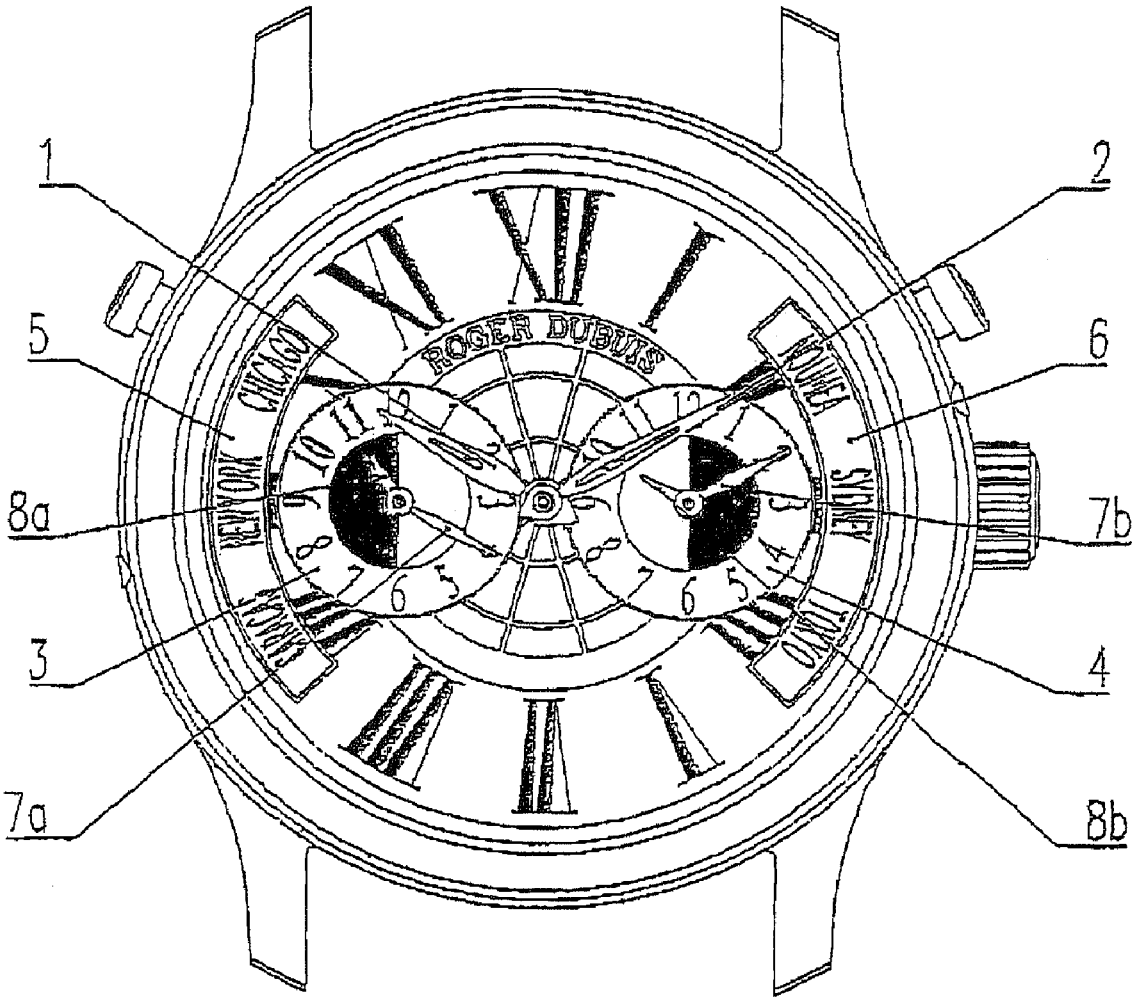
FIG. 1 is a plan view of this timepiece.

The timepiece illustrated by FIG. 1 comprises a dial opposite which two hands, for hours 1 and minutes 2, move. This dial also comprises two hour indicators 3, 4 of two time zones, identified by the name of one or more geographical locations representative of each time zone. Each of these time zones is visible through a window 5, 6 traversing the dial of the timepiece. These hour indicators 3, 4 and these windows are aligned on a diametrical line 3 o'clock to 9 o'clock of the dial. Each hour indicator comprises a graduation from 1 to 12 and, in its center, an indication of the diurnal hours, formed by a white diametrical sector, and an indication of the nocturnal hours, formed by the complementary black diametrical sector.

Each indicator of the hour of a time zone comprises two hands 7*a*, 8*a* and 7*b*, 8*b* respectively, for respectively indicating the hour with the aid of the hand 7*a*, 7*b*, and whether the hour indicated corresponds to a diurnal or nocturnal hour or, in other words, whether the hour in question is designated as AM or PM according to the Anglo-Saxon denomination, with the aid of the hands 8*a* and 8*b* respectively, which move opposite the white or black sectors of the dials 3 and 4. As will be seen in greater detail below, the hands 7*a*, 7*b* make two revolutions in twenty-four hours, whereas the hands 8*a*, 8*b* make only one revolution during the same period.

Figure 2:
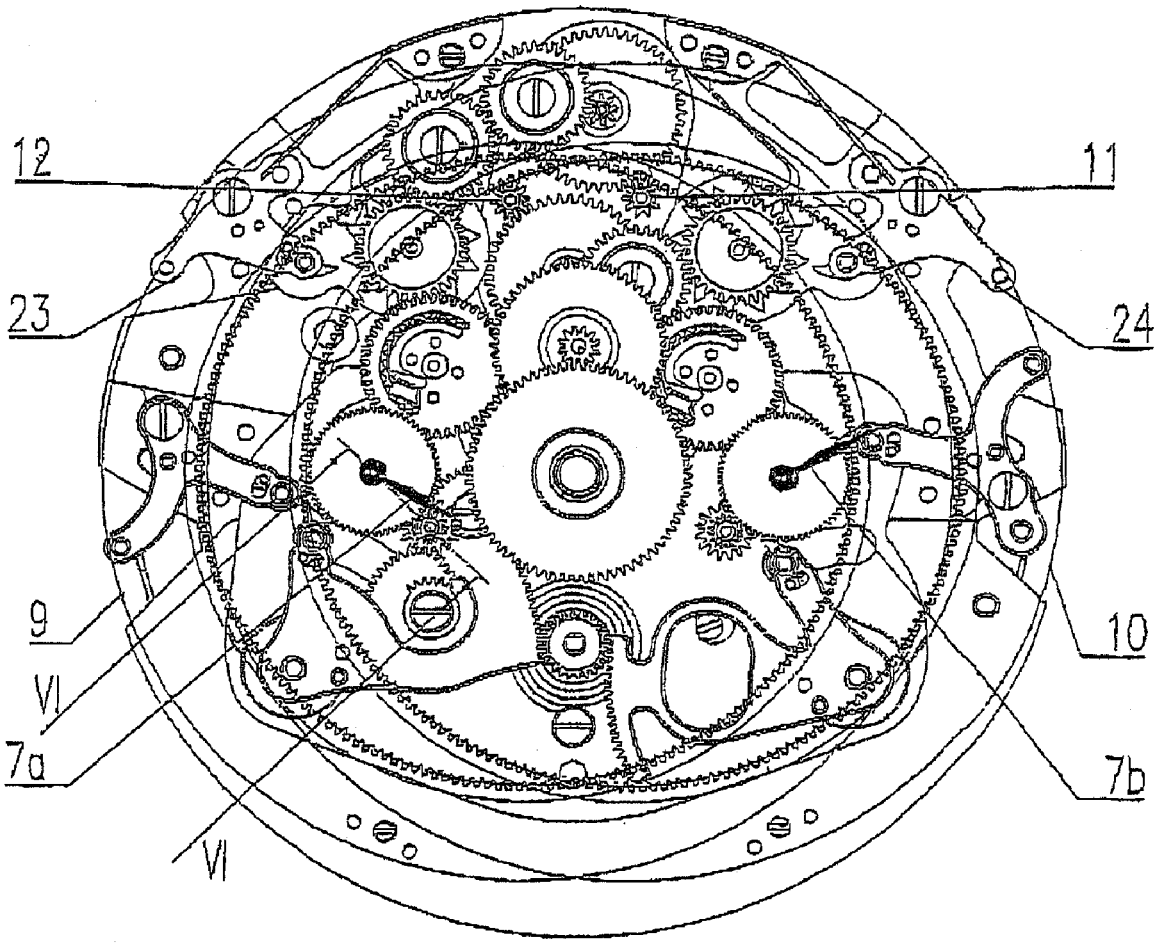
FIG. 2 is a plan view of the display mechanism of the timepiece of FIG. 1.

In FIG. 2 are found the two indicator disks 9, 10 of the two time zones appearing in the windows 5 and 6 respectively. Each of these indicator disks 9, 10 comprises an inner toothing engaging with a pinion 11 and 12 respectively.

Figure 3:
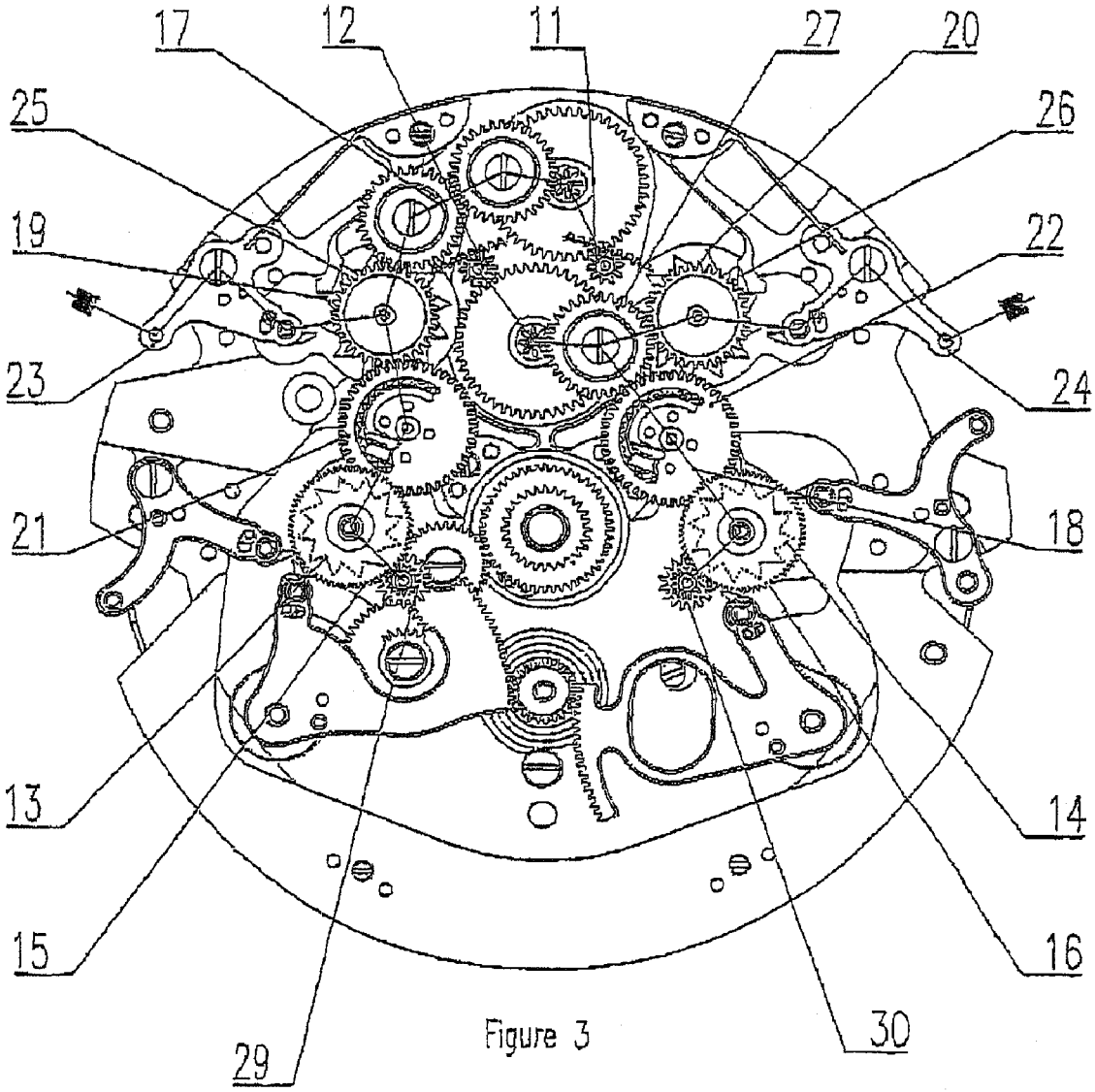
FIG. 3 is a view of the mechanism of FIG. 2 without the indicator disks, showing the kinematic chains between the disks and the hour displays of the two respective time zones.

If reference is now made to FIG. 3, the latter shows, by two broken lines 17, 18 joining the centers of the mobiles concerned, the unidirectional kinematic link between the two pinions 11 and 12 respectively, and the mobiles formed by the stars 13 and 14 respectively, coaxial with toothed mobiles 15 and 16 respectively. The stars 13, 14 are attached to the hour hands 7*a* and 7*b* respectively, while the coaxial toothed wheels 15, 16 are attached to the hands 8*a*, 8*b*.

Figure 6:
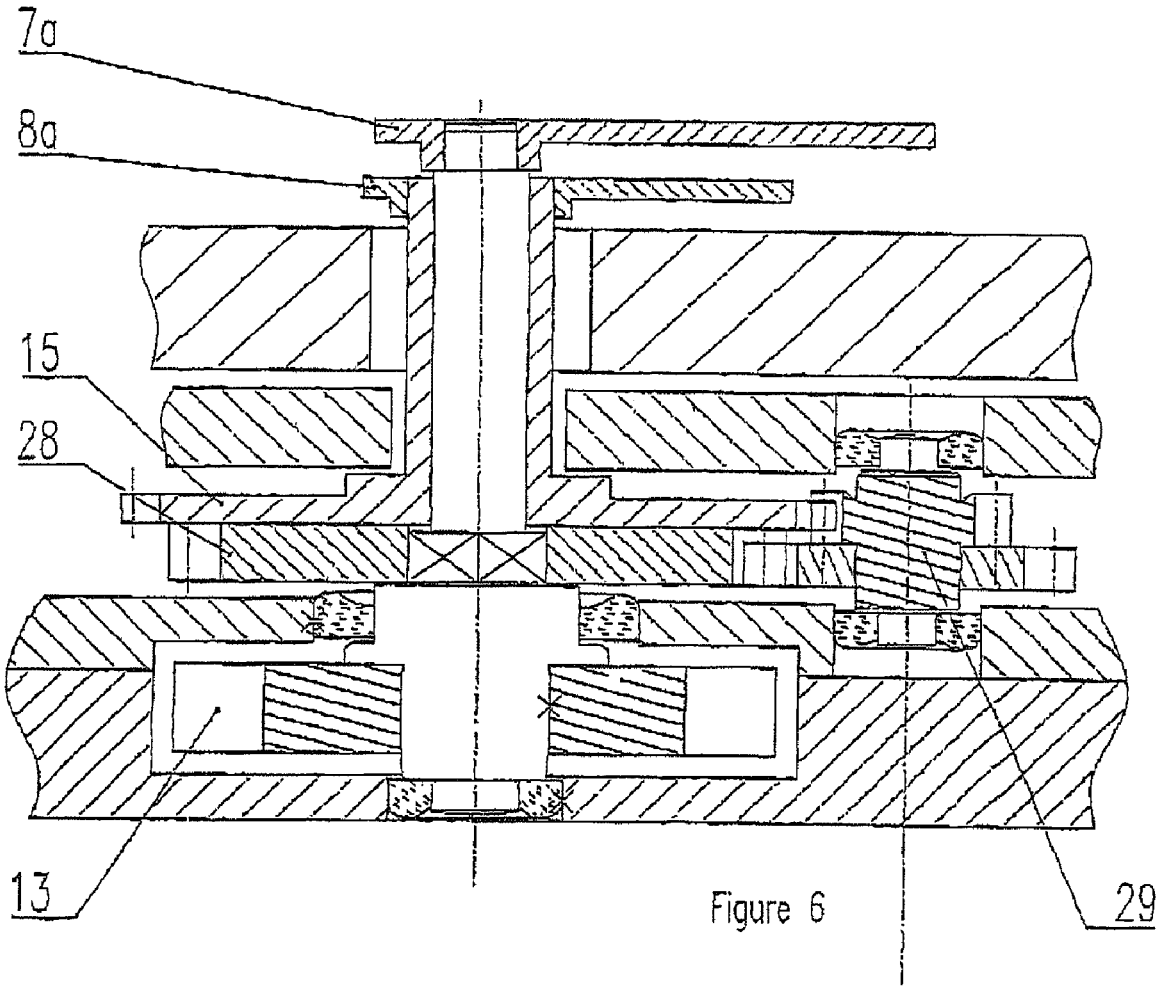
FIG. 6 is a sectional view along the line VI-VI of FIG. 2.

Each kinematic chain 17, 18 is attached to a starred mobile 19 and 20 respectively, and to a mobile with unidirectional transmission 21 and 22 respectively. Each starred mobile 19, 20 is associated with a time-zone-changing click lever 23 and 24 respectively. The lever 23 serves to drive the starred mobile 19 in the clockwise direction, while the lever 24 serves to drive the starred mobile 20 in the counterclockwise direction. Each starred mobile 19, 20 is attached to a toothed wheel 25 and 26 respectively. The toothed wheel 25 meshes directly with the unidirectional transmission mobile 21, whereas the toothed wheel 26 meshes with the unidirectional transmission mobile 22 via a gear 27, so that the two unidirectional transmission mobiles 21, 22 rotate in the same direction and each drive a toothed wheel, whereof only the wheel 28 attached to the star 13 is visible in FIG. 6. As illustrated, a double reducer mobile 29 allows the toothed wheel 15 to be driven in a ratio of 1/2 relative to the wheel 28, attached to the axle bearing the hour hand 7*a* and the star 13. An identical arrangement with a reducer mobile 30 allows the unidirectional transmission 22 to drive the hands 7*b*, 8*b*.

By virtue of these two kinematic chains 17, 18, any change of time zone actuated by one or other of the levers 23, 24 provokes the displacement of the star 19 or 20 by increments of one step, which corresponds to a 30° displacement of the indicator disk 9 or 10 corresponding to a time zone, and simultaneously to the displacement of the hand 7*a* or 7*b* by one hour and to that of the hand 8*a* or 8*b* by one twenty-fourth of the circumference, i.e. 15°, or by half a step relative to the hands 7*a*, 7*b*. Thus any change of time zone provokes the simultaneous changing of the hour corresponding to this time zone, indicated by one of the hands 7*a*, 7*b*, and the displacement of the hand 8*a* or 8*b* indicating the diurnal and nocturnal hours, or AM and PM, by one twenty-fourth of the circumference.

Figure 4:
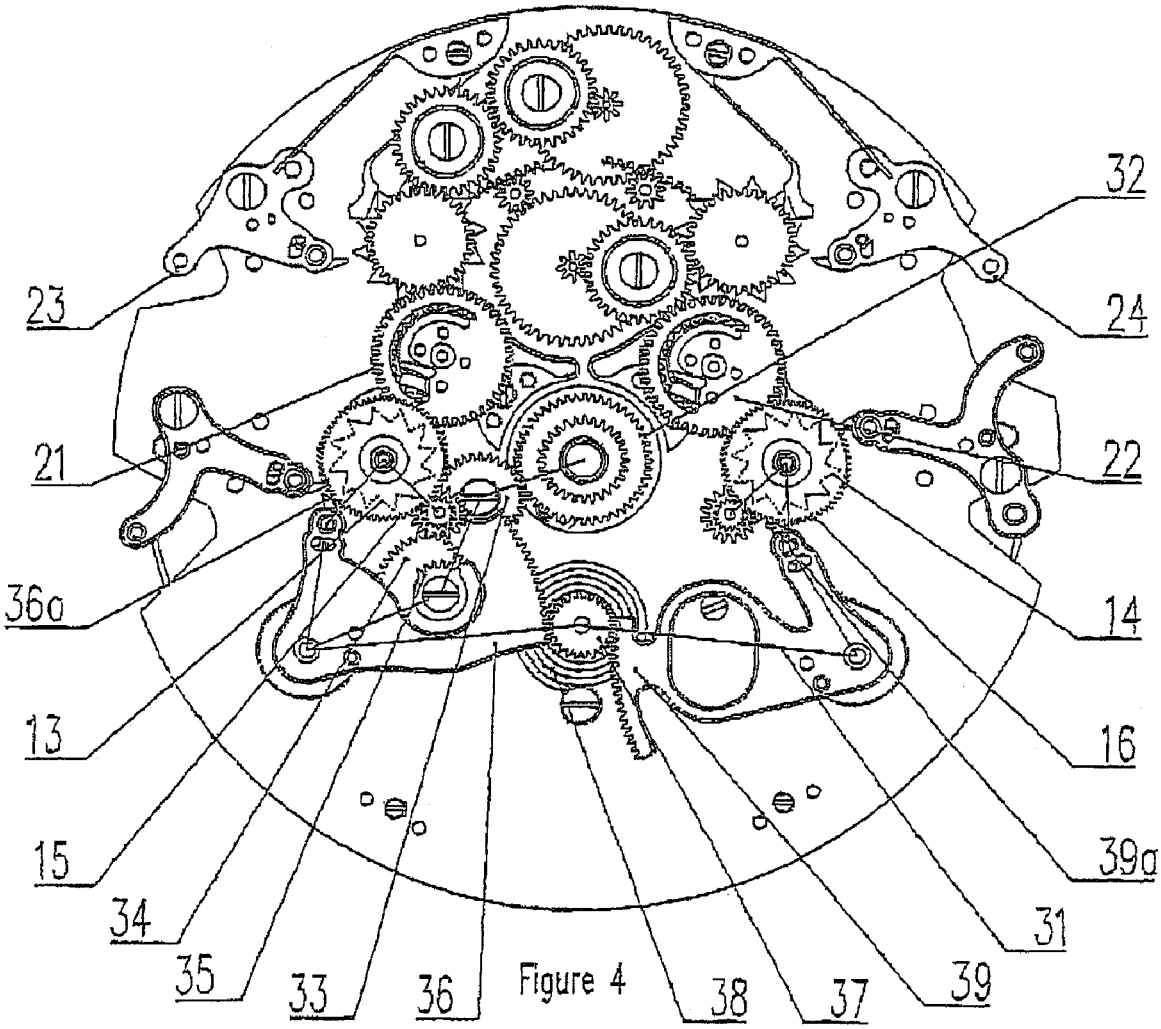
FIG. 4 is a view similar to FIG. 3, in which the kinematic chain joining the three hour displays is indicated.

FIG. 4 illustrates the kinematic chain 31, passing through the centers of the mobiles concerned, between a mobile 32 of the minute train for driving the hands 1, 2 indicating the hours and minutes of the local time, situated in the center of the timepiece, and the stars 13, 14 attached to the axles bearing the hands 7*a*, 7*b* indicating the hour of the two time zones selected by the levers 23, 24.

The mobile 32 of the minute train meshes with a gear 33 engaging with a wheel 34 bearing a toothed sector 35. This toothed sector is driven at the rate of one revolution per hour, and enters into engagement, upon each rotation, with an inner toothed sector of a rack 36. This rack 36 bears a driving click 36*a* for the star 13. This rack 36 also has an outer toothed sector in engagement with a gear 37 associated with a spiral return spring 38. This gear 37 is engaged with a second rack 39, which bears a click 39*a* intended to drive step by step the star 14 attached to the hour hand 7*b*.

At each hour, therefore, the toothed sector 35 drives the rack 36 in the counterclockwise direction. This angular displacement is transmitted to the rack 39 by the gear 37, which at the same time loads the spiral return spring 38. When the toothed sector 35 leaves the inner toothed sector of the rack 36, the spiral spring 38 slackens while driving the two racks 36 and 39, which, with the aid of their respective clicks 36*a*, 39*a*, drive the stars 13 and 14 by one step and the hands 8*a*, 8*b* by one twenty-fourth of the circumference, or half a step. Owing to the presence of the unidirectional transmission mobiles 21, 22, the drive of the members 7*a*, 7*b*, 8*a*, 8*b* for indicating the hours of the two time zones is not transmitted to the pinions 11 and 12 for driving the disks 9 and 10 for indicating the time zones.

Figure 5:
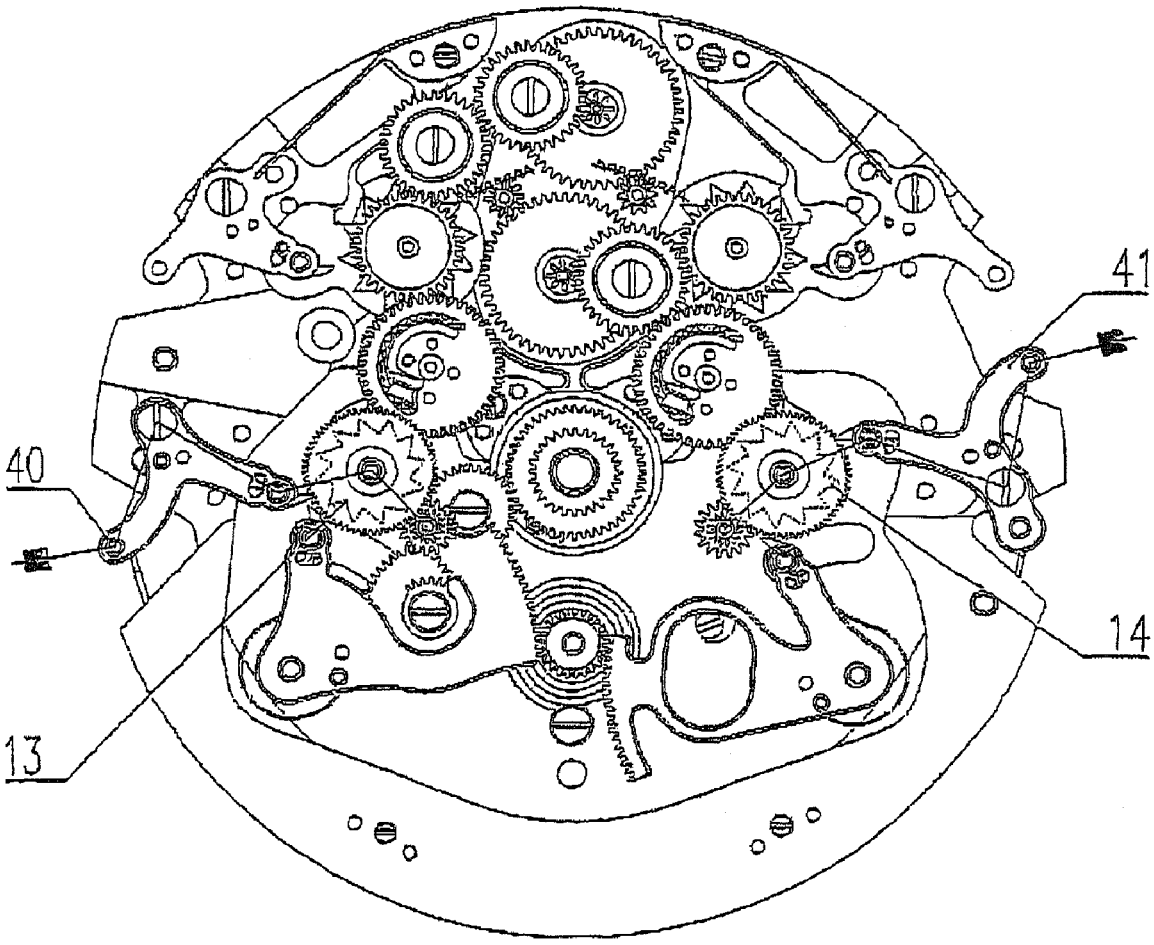
FIG. 5 is a view similar to FIG. 2, showing the hour adjusting device of the two displayed time zones.

The display mechanism for the time zones also comprises two click-type adjusting levers 40, 41 (FIG. 5) arranged for the step-by-step displacement of the stars 13 and 14. These adjusting levers 40, 41 are used only at the start-up of the timepiece and at the changeover from summertime to wintertime or vice versa for those countries in which the hour changes in the course of the year.

The invention claimed is:

1. A timepiece comprising a dial provided with means for selective and simultaneous analog display of the respective hours of a plurality of time zones, in which each of the twenty-four time zones is designated by at least one representative geographical location, wherein said time zones are distributed over two superposed, non-coaxial annular disks of same diameters disposed under said dial and each of which is divided into twelve equal angular sectors each corresponding to a time zone, each of these disks bearing the twelve time zones of a hemisphere with polar plane, the dial having two diametrically opposed windows, disposed on a diameter passing through the pivot axes of the two annular disks, each being situated opposite a segment of the trajectory of the respective disks and being dimensioned to reveal the indications relating to a time zone, each of these disks being joined, on the one hand, to a manual selection member, on the other hand, by a unidirectional kinematic link, to an hour display member of the corresponding time zone.

2. The timepiece as claimed in claim 1, in which said analog display means further comprise a local time display joined by a kinematic link to the hour display of each of said time zones.

3. The timepiece as claimed in claim 1, in which said analog display means for the hour of the said time zones comprise an hour hand driven at the rate of one revolution every twelve hours opposite a twelve-graduation dial and joined in a ratio of 1/2 to a coaxial day/night hand, which moves facing a dial divided into two equal sectors, one indicating the diurnal hours, the other the nocturnal hours.

4. The timepiece as claimed in claim 1, in which the means for driving the hour display of the different time zones are incremental drive means.

5. The timepiece as claimed in claim 1, in which the display means associated with each time zone comprise an adjusting member.

6. The timepiece as claimed in claim 2, in which said analog display means for the hour of the said time zones comprise an hour hand driven at the rate of one revolution every twelve hours opposite a twelve-graduation dial and joined in a ratio of 1/2 to a coaxial day/night hand, which moves facing a dial divided into two equal sectors, one indicating the diurnal hours, the other the nocturnal hours.

7. The timepiece as claimed in claim 2, in which the means for driving the hour display of the different time zones are incremental drive means.

8. The timepiece as claimed in claim 3, in which the means for driving the hour display of the different time zones are incremental drive means.

9. The timepiece as claimed in claim 6, in which the means for driving the hour display of the different time zones are incremental drive means.

10. The timepiece as claimed in claim 2, in which the display means associated with each time zone comprise an adjusting member.

11. The timepiece as claimed in claim 3, in which the display means associated with each time zone comprise an adjusting member.

12. The timepiece as claimed in claim 4, in which the display means associated with each time zone comprise an adjusting member.

13. The timepiece as claimed in claim 6, in which the display means associated with each time zone comprise an adjusting member.

14. The timepiece as claimed in claim 7, in which the display means associated with each time zone comprise an adjusting member.

15. The timepiece as claimed in claim 8, in which the display means associated with each time zone comprise an adjusting member.

16. The timepiece as claimed in claim 9, in which the display means associated with each time zone comprise an adjusting member.

* * * * *